US005765995A

United States Patent [19]

Springer

[11] Patent Number: 5,765,995

[45] Date of Patent: Jun. 16, 1998

[54] AUTOMATED ENGINE-POWERED PUMP CONTROL SYSTEM

[75] Inventor: Mike C. Springer, Bedford, Tex.

[73] Assignee: Diesel Power Supply Co., Waco, Tex.

[21] Appl. No.: 627,418

[22] Filed: Apr. 4, 1996

Related U.S. Application Data

[63] Continuation-in-part of Ser. No. 551,880, Oct. 16, 1995, abandoned.

[51] Int. Cl.[6] ..... F04B 49/04

[52] U.S. Cl. ..... 417/40; 417/17; 417/32; 417/34; 417/38; 417/44.2; 417/63; 123/179.4

[58] Field of Search ..... 417/11, 17, 18–24, 417/29–32, 34, 36–40, 44–2, 53, 63; 123/179.2, 179.4, 359

[56] References Cited

U.S. PATENT DOCUMENTS

| | | | |
|---|---|---|---|
| 3,866,059 | 2/1975 | Przywozny | 307/10 R |
| 4,096,830 | 6/1978 | Long | 123/32 EA |
| 4,400,935 | 8/1983 | Louis | 417/34 |
| 4,529,359 | 7/1985 | Sloan | 417/34 |
| 4,549,400 | 10/1985 | King | 417/34 |
| 4,767,280 | 8/1988 | Markuson et al. | 417/44.1 |
| 4,932,244 | 6/1990 | Yamaguchi et al. | 73/117.3 |
| 4,988,996 | 1/1991 | Ito | 340/984 |
| 5,015,152 | 5/1991 | Greene | 417/40 |
| 5,081,365 | 1/1992 | Field et al. | 290/45 |
| 5,089,676 | 2/1992 | Duncan | 417/40 |
| 5,100,298 | 3/1992 | Shibata et al. | 417/40 |
| 5,305,779 | 4/1994 | Izaguirre | 417/40 |
| 5,349,931 | 9/1994 | Gottlieb et al. | 123/179.2 |
| 5,352,095 | 10/1994 | Tanaka | 417/32 |

*Primary Examiner*—Timothy Thorpe
*Assistant Examiner*—Xuan M. Thai
*Attorney, Agent, or Firm*—Henderson & Sturm

[57] ABSTRACT

An automated control system for an engine-powered pump system. The pump system includes an engine with a battery and a pump. A control unit includes: a display, engine sensors, pump sensors, fluid level sensors, engine controllers, pump controllers, strobe light status display, and a battery recharge system.

23 Claims, 5 Drawing Sheets

AUTOMATED ENGINE-POWERED PUMP CONTROL SYSTEM

CROSS REFERENCE TO RELATED APPLICATIONS (CLAIMING BENEFIT UNDER 35 U.S.C. §120)

This application is a continuation-in-part of abandoned U.S. application Ser. No. 08/551,880 filed Oct. 13, 1995 by M. Springer (Atty. Docket No. 95 DMCB1013), which is hereby incorporated by reference, in its entirety, including Appendices.

AUTHORIZATION PURSUANT TO 37 CFR 1.71 (d)(e)

A portion of the disclosure of this patent document, including appendices, contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

1. Technical Field

The present invention relates generally to pump control systems and more particularly to a method and apparatus for automated, engine-powered pump control and more specifically to a control system which controls and monitors the operation of the pump and of the engine, which monitors critical fluid levels, which communicates system status utilizing colored strobe lights, and which monitors battery status and automatically charges the battery when the battery charge level is low.

2. Background Art

Engine-driven pump systems often are used for fluid level control in environments where electric pumps are not suitable. The most evident example of this type of environment is the one in which there is no electricity readily available to drive the electric pump systems. Typical examples of areas wherein engine-powered pump systems have been utilized include coal mining dewatering; pit dewatering such as in clay pits, sand pits and gravel pits; temporary sewer by-pass work; sewer maintenance; and remote wells. However, numerous other situations occur in which fluid level control is desired and wherein for one or more of a variety of reasons an electric pump is not desirable.

Typically in these environments, it is not necessary or desirable for the pump to run continuously. Instead, it is preferable to have the pump run only when there has been a substantial accumulation of water. When the water accumulates, it is desirable to have the engine and pump started, the accumulation of water removed, and the engine and pump shut off. Finally, because the environment in which these pumps operate is frequently remote, there is a need for control systems which monitor the water level, turn on the engine and pump when the water has accumulated, and turn off the engine and pump when the water has been removed without operator interaction.

In attempting to satisfy the above mentioned need, pump control systems have been developed which do monitor the water level and automatically start and stop the engine. Additionally, some of these control systems monitor the engine status, such as engine temperature, oil pressure, and fluid levels, and display the status on a display screen adjacent to the pump control system. However, these systems often fail to monitor all of the important features of the system including details such as whether the pump is operating properly, for example, whether it has properly primed, whether the water level sensing system is operating properly, and whether the battery level is acceptable. Also, these control systems do not monitor the engine speed with respect to the pump output to determine the most efficient operating speed.

Finally, there is the problem of monitoring the engine and pump systems. These systems are often located in environments which are not only remote, but are hazardous as well, such as at the end of a mine. Therefore, it is not desirable to constantly send an individual down to the pump to monitor its status. Wireless radio control systems can allow for remote monitoring but these systems are both complex and costly, especially in light of the fact that users often operate several pump systems.

Thus, there is a need for a pump control system which more extensively monitors and controls the engine and pump system, which monitors the battery status and automatically charges the battery when its charge level is low, which monitors the engine speed and pump output such that maximum efficiency is achieved, and which provides for an uncomplicated, efficient and economical means for remote monitoring of the system status.

DISCLOSURE OF THE INVENTION

The present invention relates generally to pump control systems and more particularly to a method and apparatus for automated, engine-powered pump control and more specifically to a control system which controls and monitors the operation of the pump and of the engine, which monitors critical fluid levels, which communicates system status utilizing colored strobe lights and which monitors battery status and automatically charges the battery when the battery charge level is low. The pump control system of the present invention includes a control unit which is typically located in close proximity to the engine and pump to be controlled. The control unit is connected to a variety of engine sensors and receives input from these sensors such that it can monitor the engine operation in a continual fashion. These engine sensors monitor items including engine speed (RPM's), oil pressure, engine temperature, fuel level, oil level, coolant level and battery charge level.

The control unit also is connected to sensors located on the pump and receives input from these sensors such that it can monitor the pump operation in a continual fashion. These pump sensors monitor items including pressure and temperature.

The control unit is also connected to a water level sensing device. The water sensing device allows the control unit to receive input regarding the level of water in the environment in which the pump system is operating. The water level sensing device can be any type of level detecting device including single float switch, dual float switch, sonar or pressure transducer. Utilizing the input from the water level sensing device, the pump determines when to start the engine and begin pumping and also how long it should maintain pumping before shutting down the system. The control unit also includes a manual override such that an operator at the control unit could manually start and stop the pumping system.

The control unit also is connected to and interfaced with the engine such that it can control the operation of the engine. These interfaces are connected to the engine starter, throttle controller, fuel controller and alternator controller. The control unit is similarly connected to and interfaced with the pump such that it can control the operation of the pump. The control unit controls the various valves which are located in the pump.

The control unit includes a display screen which provides for detailed information regarding the pump system. The control unit is also connected to and controls a set of colored strobe lights. The strobe lights are very bright such that they can be seen from a great distance, even in the daytime. These strobe lights are used to indicate the general status of the pump system to an individual not in close proximity to the control unit.

The pump system will remain idle until the input from the water level sensing device indicates that the pumping process should commence. During start-up, the control unit starts the engine, allows it to warm up, then increases the throttle appropriately to start the pumping process. The control unit monitors the pump pressures, including pump and outflow pressures, and determines if the pump has primed. If the pump has not primed, the control unit will open the head drain in order to assist the pump in priming. If the pump still will not prime, the control unit shuts down the engine such that the pump is not damaged and utilizing the colored strobe lights signals that the pump has a problem.

If the pump primes, the pump system will begin removing the accumulation of water. The control unit will monitor engine speed and pump output to determine the most efficient speed at which to operate. When the accumulated water has been removed, the invention will shut down the engine. The system will remain idle until the water level sensing devices indicate that the pumping process is necessary again. If during the idle time the control unit senses that the battery charge level is low, the control unit will start the engine and leave it running until the battery is recharged.

An object of the present invention is to provide an automated, engine-powered pump control system.

Another object of the present invention is to provide an automated, engine-powered pump control system which provides for remote system monitoring in a simple and economical manner.

Another object of the present invention is to provide an automated, engine-powered pump control system which automatically operates the engine at a speed which is efficient with respect to the output from the pump.

Still another object of the present invention is to provide an automated, engine-powered pump control system which monitors the battery condition of the engine and automatically starts the engine such that the battery can be recharged when the battery charge level becomes unacceptable.

Another object of the present invention is to provide an automated, engine-powered pump control system which assists the pump when it is having difficulty during the priming process.

Other objects, advantages, and novel features of the present invention will become apparent from the following detailed description of the invention when considered in conjunction with the accompanying drawings.

BEST MODES FOR CARRYING OUT THE INVENTION

Figure 1:
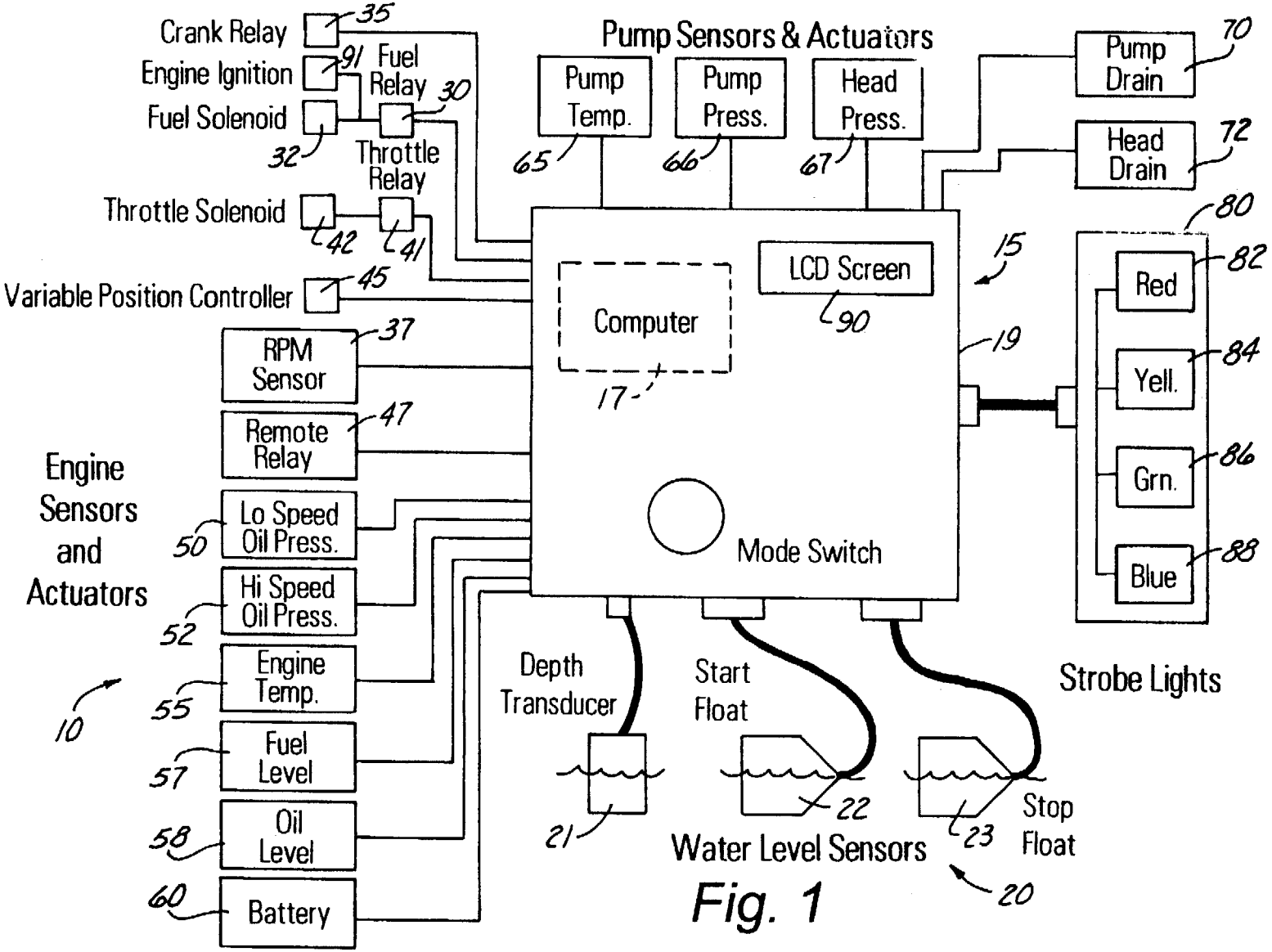
FIG. 1 is a diagrammatic illustration of an automated engine powered pump control system built in accordance with the present invention.

Referring now to the drawings wherein like reference numerals designate identical or corresponding parts throughout the several views, FIG. 1 shows a pump control system (10) for controlling and monitoring an engine drive-pump system built in accordance with the present invention. The control system (10) includes a control unit (15). The control unit (15) includes a computer (17), shown in dashed lines to indicate its presence inside a ruggedized, weather resistant housing (19). In the preferred embodiment, the computer is constructed with highly durable components which are suitably selected to withstand the operational environment in which the control system (10) will be used. Specifically, solid state circuitry is preferred. Additionally, the system should be appropriately protected from power variations in general and particularly power surges, which could damage the computer. The computer should also include an automatic reset capability. Thus, for example, if the computer "crashes" or "locks up" for more than a specific time interval, the system will automatically restart. The time interval would typically be very short and in the preferred embodiment, not more than a second or two.

Performance of the various features of the pump control system (10) are software and firmware driven on the computer (17). The use of software and firmware to control the operation of a computer and the computer operation are well known in the art and will not be discussed at length herein. Appropriate computer selection is a function of choosing a system and components which meet the durability requirements of the pump control system (10).

In the following discussion of the present invention, it should be noted that when a component or part is described as being connected to the control unit (15), the referenced component or part is connected to an interface located on the housing (19). The interface (not shown) is ultimately connected to the computer (17) either directly or via a communication bus. The connection will not be discussed in detail as computer architecture structures depend upon the computer used and are well known in the art.

The control unit (15) is used to receive input from various sensors, including a water or liquid level sensor, to determine when to start and stop the engine-driven pump system. In an engine-pump system, the pump is connected directly to an engine. Subsequently, when the engine is started, the pump begins pumping. The speed of the pump is controlled by the speed of the engine. When the engine is started such that pumping will commence, the control unit (15) monitors the status of the engine and of the pump to verify that the pumping system is operating appropriately. The control unit (15) is also connected to and interfaces with the control portions of the engine and of the pump. Thus the control unit (15) can control the operation of the engine and of the pump.

The control unit (15), and ultimately the computer (17) is connected to a variety of sensors and controls. The control unit (15) is connected to a water level sensing device (20). The water level sensing device (20) can include a depth transducer (21), a start float (22) and a stop float (23). The water level sensing device (20) indicates to the controller that the water level has accumulated to a certain height. The control unit (15) then can initiate a pumping sequence.

Additional information pertaining to the operation of the water level sensing device can be found below in the detailed discussion of FIGS. 3—5.

When the control unit (15) determines that it must initiate a pumping sequence, it sets off an audible warning to alert anyone in proximity of the engine or pump that the engine and the pump are about to start. After the audible warning, the control unit (15) begins the engine start-up sequence. The control unit (15) is connected to a fuel relay (30) which is in turn connected to the fuel solenoid (32) of the engine. The control unit (15) first actuates the fuel relay (30) such that the engine will have fuel. If the engine utilizes an ignition system, the fuel relay (30) also connects to the engine ignition (91) so that the engine ignition system will have power. Next, the control unit (15) actuates a crank relay (35) which, in turn, actuates the engine starter. Utilizing the RPM sensor (37), the control unit (15) can determine that the engine has started and disengage or deactivate the crank relay (35) such that the engine starter is shut off.

Two different embodiments of throttle control are shown in the present diagrammatic illustration of the invention. The first embodiment accomplishes throttle control through the use of the throttle relay (40). The throttle relay (41) is connected to a throttle solenoid (42) on the engine. In this configuration, the engine operates at one of two speeds: idle and full. The engine initially starts at the idle speed. The control unit (15) can cause the engine to operate at full speed by actuating the throttle relay (41) which will, in turn, activate the throttle solenoid (42) causing the engine to go to full speed. The second embodiment accomplishes throttle control through the use of a variable position control (45). The control unit (15) is connected to the variable position control (45) which allows the control unit (15) to control the engine operation at any speed between idle and full, inclusive. The preferred embodiment of the present invention uses the variable position controller (45).

If the control unit (15) desires to shut off the engine, the control unit (15) positions the engine throttle to the idle position and deactivates the fuel relay (30) thereby cutting off the fuel supply to the engine.

The control unit (15) is also connected to a remote relay (47). The control unit (15) activates the remote relay (47) prior to starting the engine. The delay between the activation of the remote relay (47) and the starting of the engine is user configureable. That is, the user can select the length of the delay. The remote relay (47) allows an accessory device to be actuated prior to engine start. For example, the user may wish to actuate a louder or different warning device. In another example, the engine may have a pre-start lubricating option or requirement. The remote relay (47) could be used to actuate this system. Also, in cold climates, the remote relay could be used to actuate an engine heater prior to attempting an engine start. The length of the time delay should be a function of the accessory device attached to the remote relay (47). If no accessory device is attached to the remote relay (47) the option can be shut off or the time delay can be set to zero.

During engine operation, the control unit (15) continually monitors the operation of the engine. The control unit (15) is connected to an RPM sensor (37) which allows the control unit (15) to monitor how fast the engine is operating. A low speed oil pressure sensor (50) allows the control unit (15) to monitor the engine oil pressure while the engine is at idle speed. A high speed, oil pressure sensor (52) allows the control unit (15) to monitor the engine oil pressure while the engine is at operational speeds.

An engine temperature sensor (55) monitors the temperature of the engine such that the control unit (15) can reduce the engine speed or shut off the engine if the engine gets too hot. Additionally, using the engine temperature sensor (55), the control unit (15) can maintain the engine at idle speed after a cold start until the engine has warmed up to an acceptable temperature.

The control unit (15) is also connected to a fuel level sensor (57). The fuel level sensor (57) communicates the fuel level to the control unit (15) such that the control unit (15) can generate an alert signal to an operator when the fuel level is low. Similarly, the control unit (15) is connected to an oil level sensor (58) and a coolant level sensor (not shown) such that the control unit (15) can monitor these fluid levels and can generate an alert message when these fluid levels become unacceptable.

The control unit (15) is also connected to the engine's battery (60) which allows the control unit (15) to monitor the charge remaining on the battery. The control unit can either include a sensing device capable of determining the charge level of the battery or such a sensing device can be positioned electronically between the battery and the control unit with the control unit receiving a charge level signal from the sensing device. If the battery charge diminishes to an unacceptable level, a situation which can occur when the engine has not been started for an extended length of time, the control unit (15) will start the engine as described above such that the battery can recharge. As mentioned above, when the engine is running, the pump is also operating. This could cause a problem during battery recharging because the pump might be running dry. It can be bad for a pump to run dry for an extended length of time.

The current invention overcomes this problem with two different approaches. In the first approach, if the engine and pump system includes a clutch between the engine and the pump, the control unit (15) can be connected to a clutch relay which in turn would be connected to a clutch mechanism such that the control unit (15) could engage the pump while the battery is charging. Thus, the pump would not operate even though the engine was running. The second approach is to limit the length of time the engine runs during the battery charge cycle. Typically, a charge cycle of ten to fifteen minutes will sufficiently recharge the battery. However, this time is sufficiently short such that damage to the pump will not occur. If the battery is not sufficiently charged after one cycle, the control unit (15) will initiate another charge cycle after a sufficiently long interval. Utilizing this second approach in combination with monitoring the pump temperature discussed below, allows the battery to be recharged without damage to the pump.

The control unit (15) is also connected to several sensors on the pump. A pump temperature sensor (65) allows the control unit (15) to monitor the temperature of the pump and reduce the operation speed, by slowing down the engine, or stop the pumping, by shutting off the engine, if the temperature gets too high. A pump pressure-sensor (66) allows the control unit (15) to monitor the pressure inside the pump. A head pressure sensor (67) allows the control unit (15) to monitor the pressure on the output side of the pump. The head pressure is a function of the pressure from the pump as well as the fluid in and configuration of the output pipes. By comparing the pump pressure and the head pressure, the control unit (15) can determine if the pump is actually pumping. That is, if the pump pressure is higher than the head pressure, the pump is pumping.

The control unit (15) can also be connected to two valves connected to the pump. The control unit (15) can open and close these valves. This control of the valves can take the form of relays which are connected to solenoids or other mechanism as discussed above or could be some other electrical-mechanical connection depending upon the particular pump of the pumping system. If during an idle period the control unit (15) determines that the temperature is below freezing as measured by the ambient temperature sensor (65) or operator input, the control unit (15) can open the pump drain (70) such that the remaining water in the pump will drain out. This will prevent the water from freezing inside the pump and causing damage to the pump.

The pumps typically must prime before they can begin pumping. If after start-up the control unit (15) determines by comparing the pressure pump and head pressure that the pump is not pumping, it assumes that the pump has not yet successfully primed. The control unit (15) can open the head drain (72) such that the water remaining in the output side of the pump will drain back into the pump. With the water from the output side now in the pump, the pump should have sufficient fluid such that it can prime. If the pump is still not pumping, either because it will not prime or because something else is wrong, the control unit (15) will determine this by a comparison of the pressures and shut down the system before any damage can occur.

The control unit (15) is connected to a bank of strobe lights (80). The strobe lights can range from just one of any color to several lights, all of a different color. The bank of strobe lights (80) can be set up at a distance away from the pump system. The maximum distance from the pump system is controlled by the length of the cable connecting the control unit (15) and the bank of strobe lights (80). As a practical matter, the cable will typically not be a great distance and is likely to be on the order of 100 feet or less. The bank of strobe lights (80) should be set in a position such that the bank (80) has a line of sight visible from a great distance. In some environments, mounting the bank of strobe lights on a pole may be appropriate.

In the preferred embodiment, the bank of strobe lights (80) includes four lights: a red light (82), a yellow light (84), a green light (86) and a blue light (88). Still in the preferred embodiment, the lights are mounted in a linear configuration and are bright enough to be seen at a great distance even in the daylight. Also, shades placed over or around each light, such as the shades placed over or around traffic lights, can help increase the long range visibility during the daylight hours.

The strobe lights are used to signal the current general status of the pump system. A green light (86) indicates that the pump is pumping and that everything is functioning properly. A yellow light (84) indicates that the pump is not operating at high speed but is alright. A red light (82) indicates that the pump is shut down for some reason. The pump system will not start itself from a red light condition until an operator resets the system after appropriate servicing. A blue light (88) indicates a problem with one of the fluid levels: fuel, coolant or oil. The control unit (15) will signal blue if service is required but will also determine the severity of the problem and make pumping decisions accordingly. Thus if a fluid level is low but there is no danger of damage, the control unit (15) may initiate pumping. Thus, it is possible for more than one light to be on at one time.

Obviously, numerous combinations of lights and colors could be used to signal a variety of conditions. The above light definitions are provided for the best mode and by way of example. The above light definitions are intuitive and require little training in order to understand the communicated message. However, more complicated systems are possible and should be considered within the scope of the present invention.

The control unit (15) also includes a display (90). The display (90) in the preferred embodiment is a four line, 20 character per line LCD display. The display is used to display the condition of the system. The display (90) is used to display the readings from the numerous sensors. The display (90) is used to indicate specifically what the problem or fault is to an operator that has been summoned to the pump system by the strobe lights. The display (90) is also used for feedback to an operator while the operator is setting the various parameters in the configuration mode, discussed below.

Figure 3:
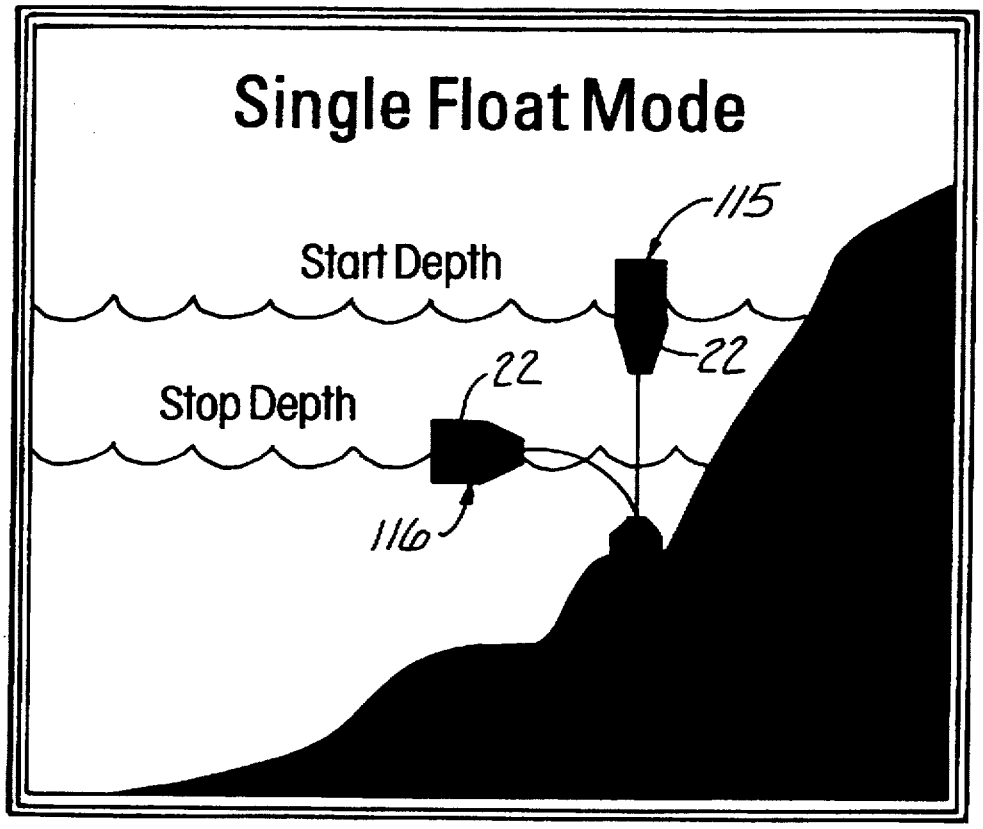
FIG. 3 is a diagrammatic illustration of a single float water sensing device.
Figure 4:
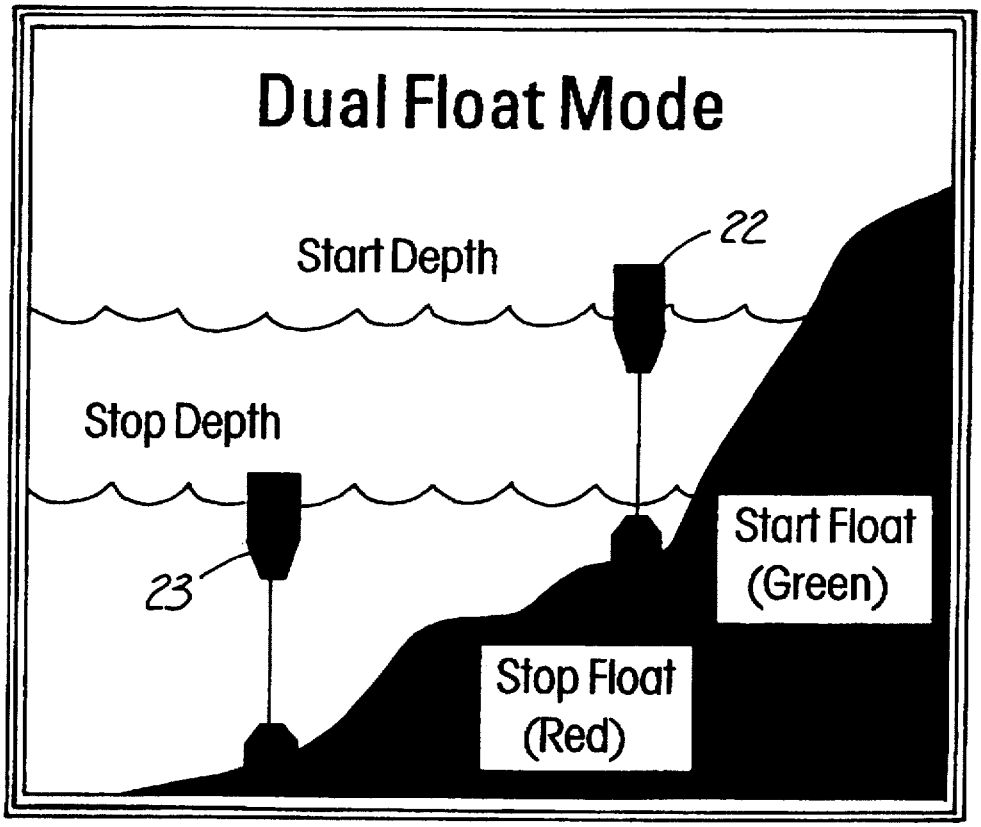
FIG. 4 is a diagrammatic illustration of a dual float water sensing device.

Referring now to FIG. 3, the operation in a single float system will be discussed. The use of float switches are well known in the art. A float switch (22) switches on when it is in an upright position (15). The float switch (22) switches off when it has tipped over into a non-upright position (116). In the single float mode, the control unit (15) initiates pumping when the float switch is in an upright position (116) and ceases pumping when the float switch is in a non-upright position (116). The benefit of the single float mode is that it tends to keep the water level constant. The disadvantage to a single float system is that it will start and stop the pump frequently. In order to correct this situation, variations of this approach can be used. For example, the pumping can commence when the float switch (22) is in an upright position (115). Instead of ceasing as soon as the switch (22) tips over, the pumping can continue for a predetermined length of time. This length of time can be configured by the user. In another variation, after the float switch (22) tips, the pump can remain on at an idle speed for a given length of time. If after that given length of time the float switch (22) has not returned to the upright position (115), the system can be shut off.

Another alternative is to use a dual float system. Referring now to FIG. 4, operation in the dual float mode will be discussed. In a dual float mode, two float switches (22 & 23) are used. One float switch (22) is used to determine when to commence pumping and the other float switch (23) is used to determine when to cease pumping. In one embodiment, the control unit (15) allows the operator to designate one switch as the start switch and one switch as the stop switch. The control unit (15) can indicate a warning when it senses that the switches are reversed. This condition occurs when the start switch is upright but the stop switch is tipped. In an alternative embodiment, the control unit (15) begins pumping when both switches (22 & 23) are in the upright position and ceases when both switches (22 & 23) have tipped over. This embodiment uses the two different levels but does not require a specific start and specific stop switch.

Figure 5:
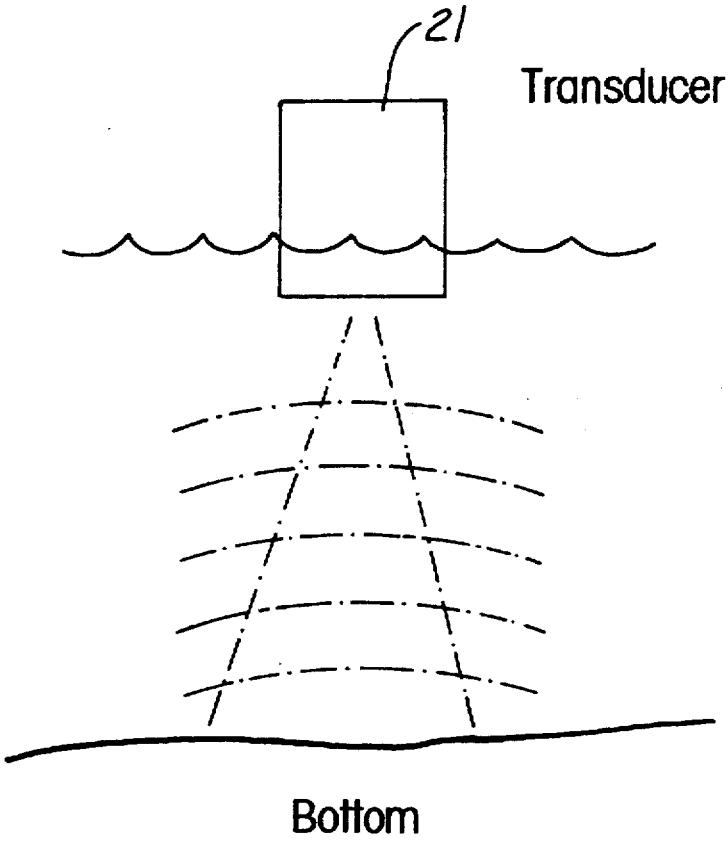
FIG. 5 is a diagrammatic illustration of a sonar water sensing device.

Referring to FIG. 5, a sonar transducer (21) is used to determine the level of the water. The sonar transducer (21) floats on the surface of the water and senses the distance to the bottom. Additionally, a pressure transducer (not shown) can be used to sense the liquid level.

Figure 2:
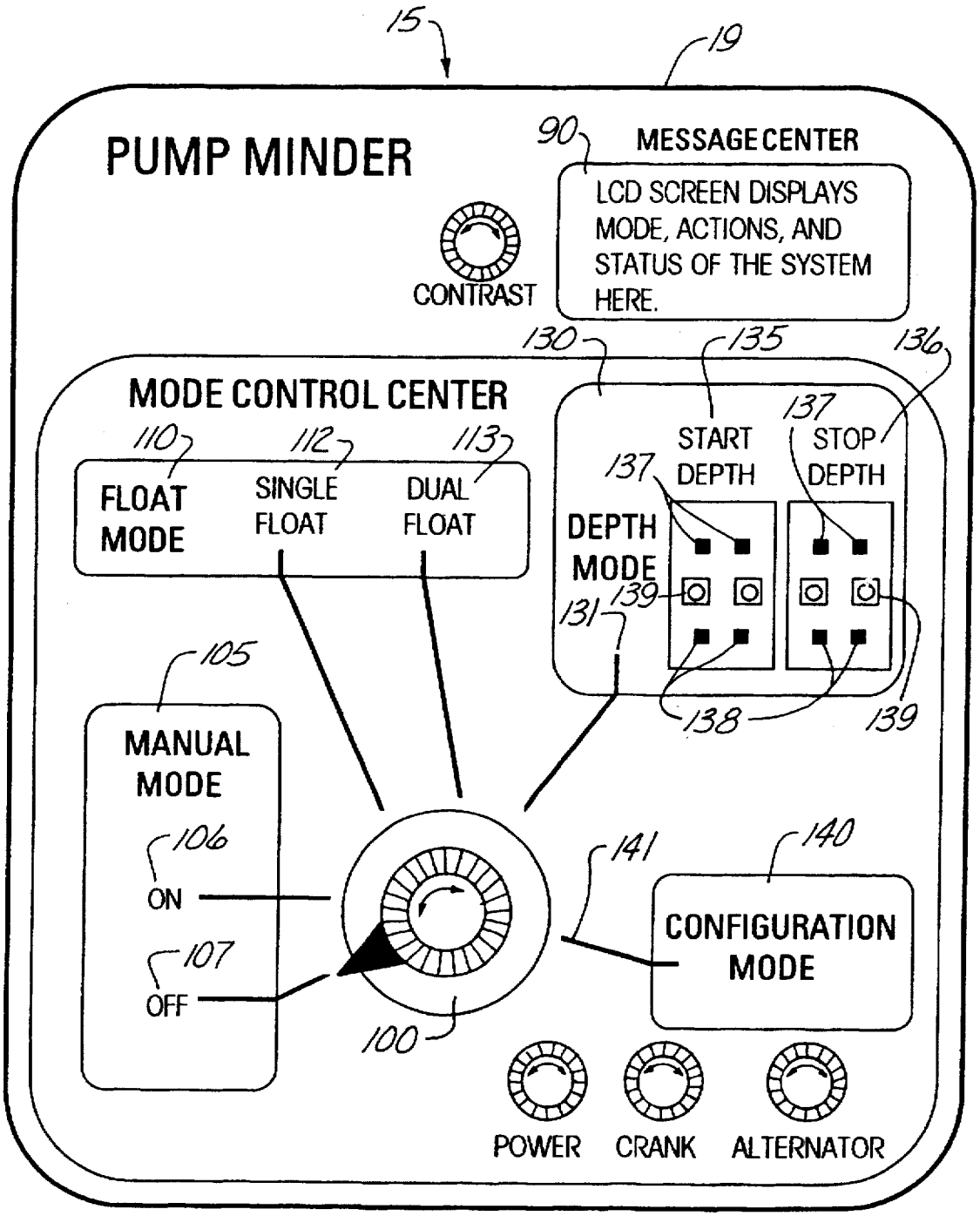
FIG. 2 is a diagrammatic illustration of the face of the control unit of the present invention.

Referring again to FIG. 2, the control unit (15) can operate in the depth mode (130) by setting the knob (100) to position (131). In the depth mode (130), the control unit (15) utilizes the reading it obtains from the sonar or depth transducer (21). The operator selects a start depth (135) and a stop depth (136). The user sets the depths utilizing up buttons (137) and down buttons (138). In another embodiment, thumb nail dials could be used. In this mode, the control unit (15) will commence pumping when the water level, as read by the transducer (21), reaches the start depth (135). The control unit (15) will cease pumping when the water level, as read by the transducer (21), lowers to the stop depth (136). An error message will be indicated by the control unit (15) if the operator selects a stop depth (136) greater than the start depth (135).

In the configuration mode (140), achieved by placing knob (100) in position (141), the user can select the various user configurations and options discussed above.

During pumping, the control unit (15) will attempt to operate the pump at the most efficient speed. In order to determine the most efficient speed, the control unit (15) will vary the speed of the engine between full speed and some minimal operational speed while looking at the pressure differential between the pump pressure and the head pressure. Utilizing these comparisons, the control unit (15) can determine the most efficient speed at which to run the engine.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An automated control system for an engine-powered pump system, said pump system including an engine and a pump, said engine including a battery; comprising:

a control unit, said control unit including a computer;

engine sensing means operably connected to said control unit for monitoring the status of the engine;

pump sensing means operably connected to said control unit for monitoring the status of the pump;

liquid level sensing means operably connected to the control unit for sensing the liquid level in the environment in which said pump system is operating;

engine control means operably connected to the control unit and operably interfaced with the engine for controlling the operation of the engine;

pump control means operably connected to the control unit and operably interfaced with the pump for controlling the operation of the pump; and strobe light display means operably connected to said control unit for long range communication of the status of the pump system.

2. The automated control system of claim 1 wherein said engine sensing means includes means for sensing engine speed.

3. The automated control system of claim 1 wherein said engine sensing means includes means for sensing engine temperature.

4. The automated control system of claim 1 wherein said engine sensing means includes fluid sensing means for sensing one or more of said engine fluid levels.

5. The automated control system of claim 4 wherein said fluid sensing means includes means for sensing the fuel level of said engine.

6. The automated control system of claim 4 wherein said fluid sensing means includes means for sensing the oil level of said engine.

7. The automated control system of claim 4 wherein said fluid sensing means includes means for sensing the coolant level of said engine.

8. The automated control system of claim 1 wherein said engine sensing means includes means for sensing the level of charge of said battery.

9. The automated control system of claim 8 wherein said control unit includes means for temporarily operating said engine and thereby charging said battery upon sensing a low charge on the battery from said means for sensing the level of charge of said battery.

10. The automated control system of claim 1 wherein said pump sensing means includes means for sensing the temperature of said pump.

11. The automated control system of claim 1 wherein said pump sensing means includes means for sensing the pressure inside said pump.

12. The automated control system of claim 11 wherein said pump sensing means includes means for sensing the head pressure of the pump system.

13. The automated control system of claim 1 wherein said pump control means includes means for selectively opening and closing a drain valve.

14. The automated control system of claim 1 wherein said pump control means includes means for selectively opening and closing a head valve.

15. The automated control system of claim 1 including a display operably attached to said control unit.

16. The automated control system of claim 1 wherein said engine control means includes throttle control means for controlling the operational speed of the engine.

17. The automated control system of claim 16 wherein said throttle control means includes:

a first setting for operating the engine at an idle speed; and a second setting for operating the engine at full speed.

18. The automated control system of claim 16 wherein said engine throttle means include variable setting means for operating the engine at speeds between idle speed and full speed inclusive.

19. The automated control system of claim 18, including:

wherein said pump sensing means includes means for sensing the pressure inside said pump;

wherein said pump sensing means includes means for sensing the head pressure of the pump system;

means for comparing the pressure inside the pump to the head pressure at various engine speeds between idle speed and full speed inclusive; and means for selecting the engine speed for operation which resulted in the greatest pressure differential during comparison.

20. The automated control system of claim 1 wherein said liquid level sensing means includes a single float system.

21. The automated control system of claim 1 wherein said liquid level sensing means includes a dual float system.

22. The automated control of claim 1 wherein said liquid level sensing means includes a sonar transducer.

23. The automated control system of claim 1 wherein said liquid level sensing means includes a pressure transducer.

* * * * *